US006947678B2

(12) United States Patent
Ohtomo et al.

(10) Patent No.: US 6,947,678 B2
(45) Date of Patent: Sep. 20, 2005

(54) IMAGE FORMING APPARATUS AND CARTRIDGE, METHOD OF SENSING REMAINING AMOUNT OF DEVELOPER IN AN IMAGE FORMING APPARATUS, AND MEMORY DEVICE MOUNTED ON SAID CARTRIDGE

(75) Inventors: Yasunao Ohtomo, Shizuoka (JP); Norihito Naito, Shizuoka (JP); Hideaki Hasegawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 122 days.

(21) Appl. No.: 10/372,789

(22) Filed: Feb. 26, 2003

(65) Prior Publication Data

US 2003/0165344 A1 Sep. 4, 2003

(30) Foreign Application Priority Data

Mar. 1, 2002 (JP) ..... 2002-056422

(51) Int. Cl.[7] ..... G03G 15/08; G03G 15/10
(52) U.S. Cl. ..... 399/27; 399/61
(58) Field of Search ..... 399/27, 45, 53, 399/58, 61, 62

(56) References Cited

U.S. PATENT DOCUMENTS

| | | | | | |
|---|---|---|---|---|---|
| 5,235,384 | A | * | 8/1993 | Oka et al. | 399/27 |
| 5,923,917 | A | * | 7/1999 | Sakurai et al. | 399/27 |
| 6,275,665 | B1 | * | 8/2001 | Miyashiro | 399/27 |
| 6,282,384 | B1 | * | 8/2001 | Saito et al. | 399/27 |
| 6,343,193 | B1 | * | 1/2002 | Matsumoto et al. | 399/27 |
| 6,349,184 | B2 | * | 2/2002 | Otomo | 399/27 |
| 2002/0127024 | A1 | | 9/2002 | Matsumoto et al. | 399/27 |

* cited by examiner

*Primary Examiner*—Sandra L. Brase
(74) *Attorney, Agent, or Firm*—Fitzpatrick, Cella, Harper & Scinto

(57) ABSTRACT

An image forming apparatus has full- and half-speeds as image forming speeds. In the full-speed mode, a detected voltage value conforming to the electrostatic capacity between a developing roller and plate antenna of a process cartridge is converted to the amount of toner remaining in the apparatus. In the half-speed mode, on the other hand, the amount of remaining toner is found using a value obtained by adding a correction value δ to the detected voltage value conforming to the electrostatic capacity between the developing roller and the plate antenna. As a result, the amount of toner can be sensed accurately even if the electrification conditions of an image carrier change.

19 Claims, 17 Drawing Sheets

FIG. 17

CONVERSION TABLE FOR OBTAINING REMAINING AMOUNT OF TONER

| REMAINING AMOUNT OF TONER g (%) | DETECTED VALUE (v) |
|---|---|
| 50(10) | 1.0 |
| 45(9) | 1.2 |
| 40(8) | 1.4 |
| 35(7) | 1.6 |
| 30(6) | 1.8 |
| 25(5) | 2.0 |
| 20(4) | 2.2 |
| 15(3) | 2.4 |
| 10(2) | 2.6 |
| 5(1) | 2.8 |

IMAGE FORMING APPARATUS AND CARTRIDGE, METHOD OF SENSING REMAINING AMOUNT OF DEVELOPER IN AN IMAGE FORMING APPARATUS, AND MEMORY DEVICE MOUNTED ON SAID CARTRIDGE

FIELD OF THE INVENTION

This invention relates to an image forming apparatus and cartridge that use a developer such as a toner, to a method of sensing the remaining amount of developer in the image forming apparatus, and to a memory device mounted on the cartridge.

BACKGROUND OF THE INVENTION

An image forming apparatus according to the prior art has developer accommodating means for accommodating a developer, and a developer carrier for carrying the developer. In an image forming apparatus of this kind, sensing the remaining amount of developer inside the developer accommodating means by utilizing voltage impressed upon the developer carrier is well known in the art.

For example, a voltage is impressed upon the developer carrier and the electrostatic capacitance between the developer carrier and a developer sensing member, such as a plate antenna provided in the container, is detected, thereby sensing the amount of developer within the developer accommodating container.

However, when the amount of developer is sensed according to the prior art described above, the prior art does not sense the amount of developer taking into consideration the electrification conditions of an electrifying member that is for the purpose of electrifying an image carrier.

For example, a change in the frequency of electrification applied to the electrifying member that electrifies the image carrier has an effect upon the electrostatic capacitance in the container. Accordingly, in a case where an electrification condition of the image carrier is changed, the amount of developer cannot be sensed accurately.

SUMMARY OF THE INVENTION

Accordingly, an object of the present invention is to make it possible to sense the amount of developer in a developer accommodating container accurately even if the electrification conditions of an image carrier change.

Another object of the present invention is to provide an image forming apparatus and cartridge that make it possible to sense the amount of developer in a developer accommodating container accurately even if the electrification conditions of an image carrier change, a method of sensing the amount of developer in this image forming apparatus, a memory device mounted on the cartridge, and a system for controlling the image forming apparatus.

According to the present invention, the foregoing objects are attained by providing an image forming apparatus comprising: an image carrier for carrying an electrostatic latent image; a developer accommodating container for accommodating a developer for developing the electrostatic latent image on the image carrier, a developer carrier for carrying the developer; an electrifying member for electrifying the surface of the image carrier; and a control unit for obtaining the amount of developer in the developer accommodating container based upon a value that conforms to the electrostatic capacity between the developer carrier and a developer sensing member, which is for sensing the amount of developer in the developer accommodating container; wherein the control unit corrects the value, which conforms to the electrostatic capacity between the developer carrier and the developer sensing member, based upon electrification conditions for electrifying the image carrier, and obtains the amount of developer in the developer accommodating container based upon the corrected value.

According to the present invention, the foregoing objects are attained by providing a cartridge removably loaded in an image forming apparatus, the cartridge comprising: an image carrier for carrying an electrostatic latent image; a developer accommodating container for accommodating a developer for developing the electrostatic latent image on the image carrier; a developer carrier for carrying the developer, a developer sensing member for sensing the amount of developer in the developer accommodating container; an electrifying member for electrifying the surface of the image carrier; and storage means for storing information relating to the cartridge; wherein the storage means has a storage area for storing a correction value that is for correcting a value, which conforms to the electrostatic capacity between the developer carrier and the developer sensing member, based upon electrification conditions for electrifying the image carrier.

According to the present invention, the foregoing objects are attained by providing a memory device mounted on a cartridge removably loaded in an image forming apparatus that includes an image carrier for carrying an electrostatic latent image; a developer accommodating container for accommodating a developer for developing the electrostatic latent image on the image carrier; a developer carrier for carrying the developer, a developer sensing member for sensing the amount of developer in the developer accommodating container; and an electrifying member for electrifying the surface of the image carrier, the memory device having a storage area for storing a correction value that is for correcting a value, which conforms to the electrostatic capacity between the developer carrier and the developer sensing member, based upon electrification conditions for electrifying the image carrier.

According to the present invention, the foregoing objects are attained by providing a method of controlling an image forming apparatus that includes an image carrier for carrying an electrostatic latent image; a developer accommodating container for accommodating a developer for developing the electrostatic latent image on the image carrier; a developer carrier for carrying the developer; an electrifying member for electrifying the surface of the image carrier; and a control unit for obtaining the amount of developer in the developer accommodating container based upon a value that conforms to the electrostatic capacity between the developer carrier and a developer sensing member, which is for sensing the amount of developer in the developer accommodating container; the method comprising: a sensing step of sensing a value that conforms to the electrostatic capacity; a correction step of correcting the value, which has been sensed at the sensing step, based upon electrification conditions for electrifying the image carrier by the electrifying member; and a step of obtaining the amount of developer in the developer accommodating container based upon the corrected value obtained at the correction step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 17 is a diagram showing the details of a table for converting values to the remaining amounts of toner.

DESCRIPTION OF THE PREFERRED EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically slated otherwise.

First Embodiment

A laser printer will now be described as a first embodiment of an image forming apparatus according to the present invention.

Figure 5:
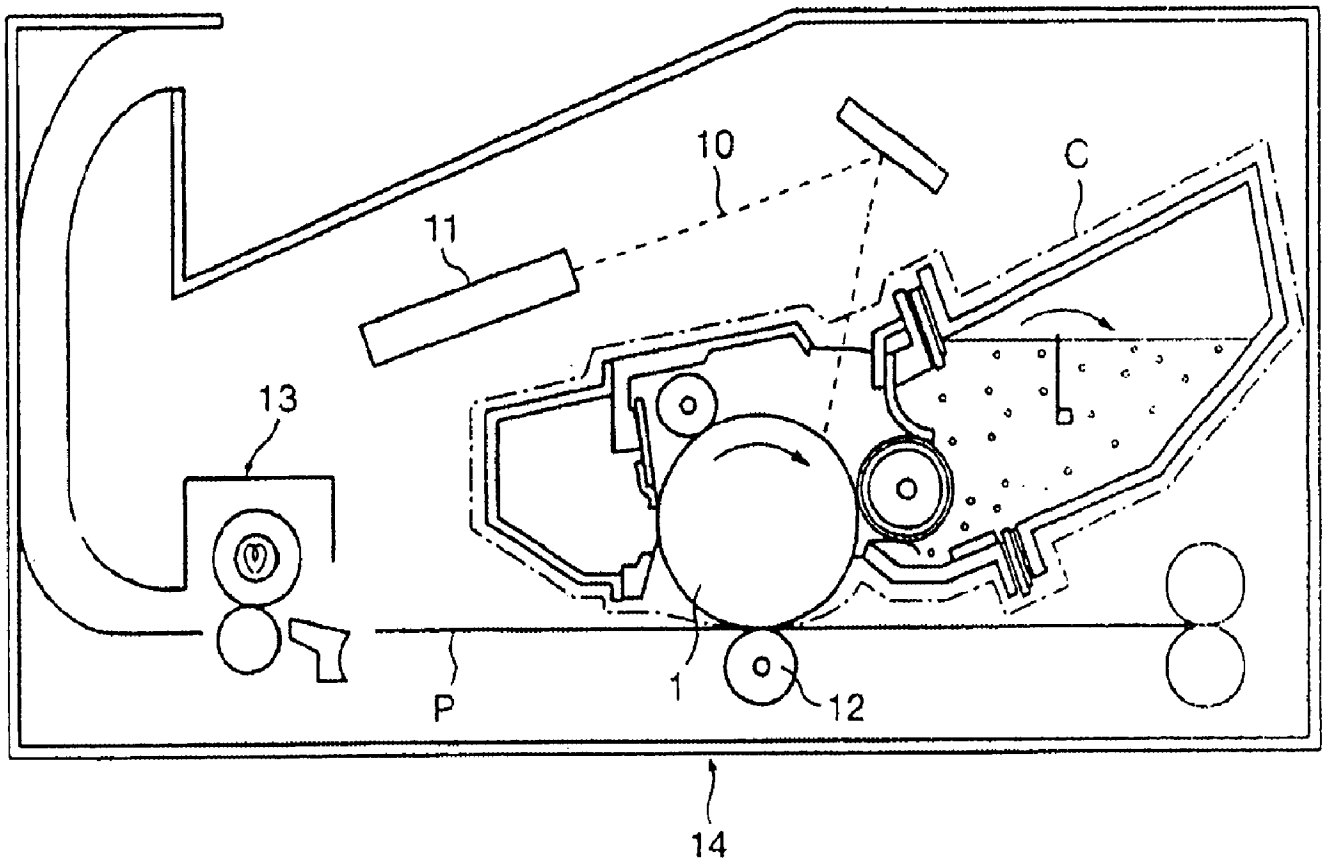
FIG. 5 is a diagram schematically illustrating the structure of a laser printer according to the first embodiment.

FIG. 5 is a diagram schematically illustrating the structure of a laser printer according to a first embodiment of the present invention. A printer 14 includes a laser scanner 11, a transfer roller 12 and a fixing unit 13 and is so adapted that a process cartridge C can be loaded removably.

The laser scanner 11 emits a laser beam 10 that conforms to entered image information. The laser beam 10 is reflected by a mirror and irradiates a prescribed position on a photosensitive drum 1 serving as an image carrier provided in the process cartridge C. As a result, a latent image is formed on the photosensitive drum 1. The latent image is supplied with a developer (toner), whereby the image is rendered visible, and the image that has been made visible is transferred to a print medium P by the transfer roller 12. The print medium P to which the image has been transferred is transported to the fixing unit 13, where heat and pressure are applied to form an image on the print medium P.

Figure 4:
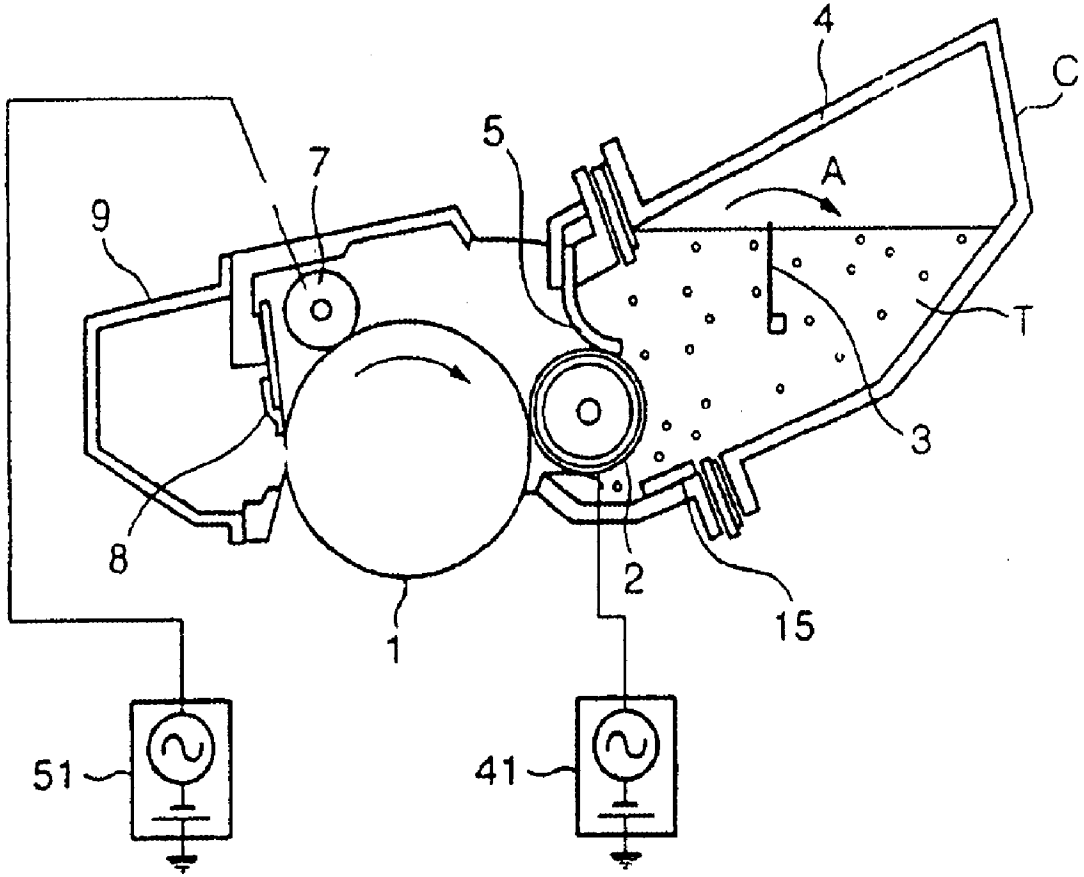
FIG. 4 is a diagram illustrating the internal structure of a process cartridge according to the first embodiment.

FIG. 4 is a diagram illustrating the internal structure of the process cartridge C according to the first embodiment.

The process cartridge C has a structure in which the photosensitive drum 1, a developing roller 2, a toner container 4, an electrifying unit (electrifying roller) 7, a cleaner 8, and a waste toner container 9 are integrated into a whole. The toner container 4 accommodates toner T. It should be noted that the process cartridge may be constructed by unifying the photosensitive drum 1, the developing roller 2, the toner container 4 and the electrifying unit (electrifying roller) 7 from which the cleaner 8 and the waste toner container 9 have been excluded. Here the toner T is an insulating magnetic single-component toner. However, the present invention is not limited to such a toner, which may be any developer inclusive of two-component toners.

When an image is formed, a bias voltage is impressed upon the electrifying unit 7, which serves as an electrifying member, by a power supply 51 of the printer main unit before the laser beam 10 is emitted, as a result of which the surface of the photosensitive drum 1 is charged uniformly by the electrifying unit 7. Next, the surface of the charged photosensitive drum 1 is scanned and exposed by the laser beam 10 to form an electrostatic image that conforms to the image information.

Next, a bias voltage is applied to the developing roller 2, which serves as a developer carrier, by a power supply 41 of the printer proper. As a result, the toner T flies from the surface of the developing roller 2 toward the electrostatic latent image so that the latent image on the photosensitive drum 1 is visualized by the toner T. The toner image thus formed on the surface of the photosensitive drum 1 is transferred to the print medium P by the transfer roller 12 in the manner described above.

When transfer ends, the cleaner 8 removes the toner remaining on the surface of the photosensitive drum 1. The remaining toner removed from the photosensitive drum 1 by the cleaner 8 is received in the waste toner container 9.

A stirring device 3 that rotates in the direction of arrow A is provided within the toner container 4 and, by being rotated, stirs and supplies the toner T to the developing roller 2.

A plate antenna 15 that constructs part of means for sensing the amount of developer is disposed within the toner container 4. The plate antenna 15 is a metal plate disposed on the bottom of the toner container 4 so as to oppose the developing roller 2. It is preferred that an SUS stainless steel that is strongly resistant to rust be used as the plate material. However, the invention is not limited to this material and other materials will suffice so long as a current can be passed through them.

When an AC bias is applied to the developing roller 2, a minute current is produced in the plate antenna 15. The minute current is sensed and converted to a detected voltage value, and the electrostatic capacity between the plate antenna 15 and the developing roller 2 is derived by calculation. Since the electrostatic capacity between the plate antenna 15 and the developing roller 2 varies in accordance with the amount of insulating toner present between them, the amount of toner can be derived accurately if the electrostatic capacity can be detected accurately.

More specifically, in a case where a prescribed amount of the toner T is present in the toner container 4, the electrostatic capacity between the plate antenna 15 and the developing roller 2 is large. As the amount of toner diminishes, the air between the container 4 and the antenna 15 increases and the electrostatic capacity declines. The detected voltage value is small when the electrostatic capacity is large and is large when the electrostatic capacity is small.

When the space between the plate antenna 15 and the developing roller 2 is full of toner, the detected voltage value takes on the minimum value (the electrostatic capacity takes on the maximum value). The detected voltage value varies in dependence upon the remaining amount of toner. If toner in excess of a predetermined amount remains in the toner container 4, the amount of toner is such that the detection region will always be full. The detected voltage value, therefore, will be constant irrespective of the amount of toner. In other words, a change in the detected voltage value and the ability to sense the amount of toner accurately occurs only when the amount of toner is less than the predetermined amount. However, since an inadequacy in the amount of remaining toner must be reported to the user, the plate antenna 15 is disposed in such a manner that the predetermined amount of toner will be of a certain magnitude. Further, the relationship (e.g., a look-up table or mathematical expression) between the detected voltage value and amount of toner is determined in advance and the amount of toner is sensed from the detected voltage value.

On the other hand, either a full-speed mode, which is the usual image forming speed, or a half-speed mode (a process speed that is half the usual image forming speed) can be selected as the image forming speed (process speed) at the printer. This printer adopts an AC contact electrification method for electrifying the surface of the photosensitive drum by applying a voltage (a voltage obtained by superimposing an oscillating voltage Vac and a DC voltage Vdc) to the electrifying roller 7 in a state in which the electrifying roller 7 is in contact with the photosensitive drum. If, in a case where the printer is controlled so that its process speed is made half speed in this contact electrification method, control has been exercised to set an electrification frequency and an electrification current value that are electrification conditions used in the full-speed mode, and the electrification frequency and the electrification current value will not be those that conform to the change in process speed. As a consequence, there is the possibility that a moiré image (interference fringes) will occur. In order to avoid the occurrence of a moiré image, different electrification conditions are set for each of the two modes. More specifically, in the full-speed mode, the electrification frequency and the electrification current value are set to be higher than those in the half-speed mode. For example, the electrification frequency and the electrification current value are set to 3000 Hz and 2500 $\mu$A, respectively, in the full-speed mode and to 1500 Hz and 1500 $\mu$A, respectively, in the half-speed mode. Thus, in the full-speed mode, the electrification frequency and the electrification current value are approximately twice those in the half-speed mode.

Figure 3:
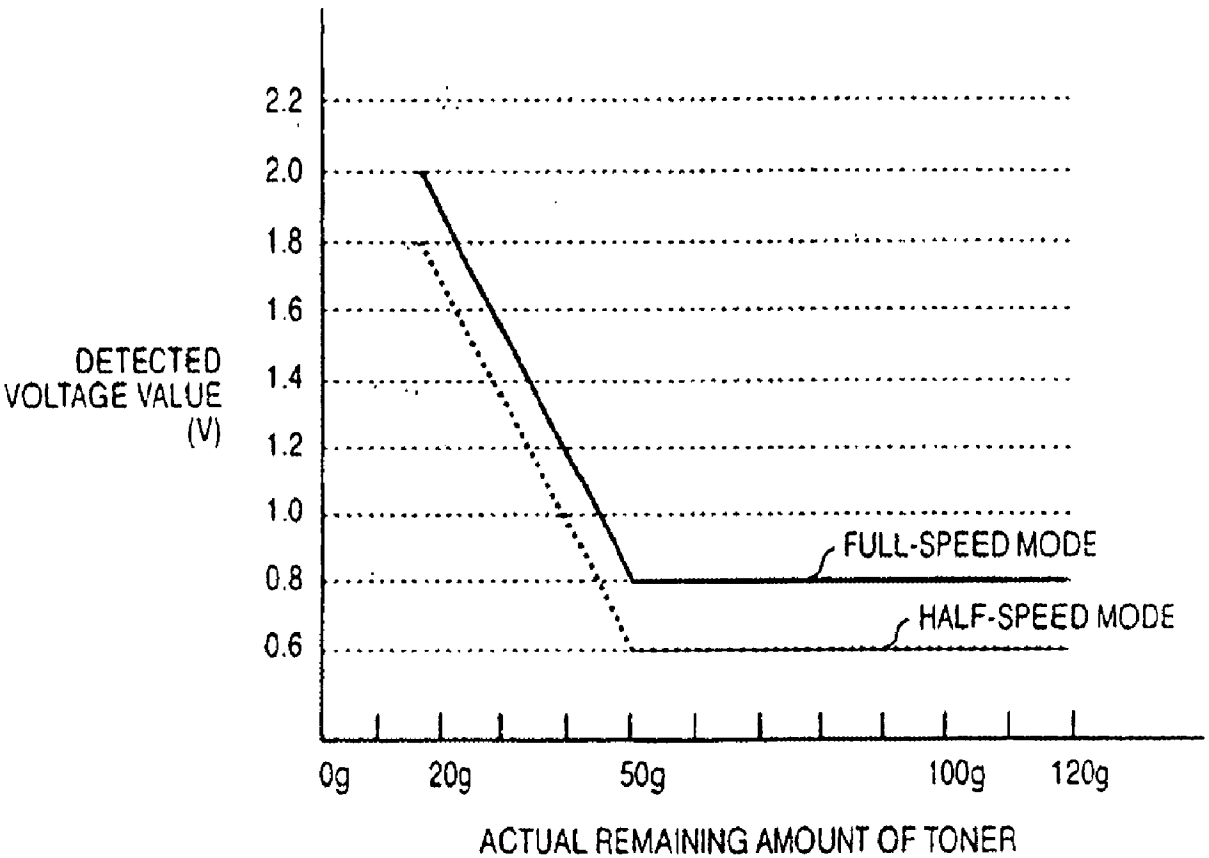
FIG. 3 is a graph illustrating an example of the relationship between a voltage value, which is sensed by the printer according to the first embodiment, and the actual remaining amount of toner.

FIG. 3 is a graph illustrating the difference in the detection voltage values between the two modes in the printer according to the first embodiment of the invention. In the graph of FIG. 3, the amount of remaining toner in the developing device is plotted along the horizontal axis, and the detected voltage value measured between the plate antenna 15 and the developing roller 2 is plotted along the vertical axis.

In a case where the electrostatic capacity between the plate antenna 15 and developing roller 2 is sensed, the current produced by the plate antenna 15 by applying an AC bias to the developing roller 2 is sensed and the sensed current is converted to a detected voltage value, thereby obtaining a detected voltage value that corresponds to the electrostatic capacity between the plate antenna 15 and the developing roller 2.

This detecting operation is performed during execution of printing. When detection is carried out, an electrostatic capacity is produced between the electrifying roller 7 and plate antenna 15, though this is very small in comparison with the sensed value between the developing roller 2 and plate antenna 15, and this is sensed as a value that has been added to the electrostatic capacity between the developing roller 2 and plate antenna 15.

Further, the electrostatic capacity between the electrifying roller 7 and the plate antenna 15 also is detected as current in a manner similar to that of the electrostatic capacity between the developing roller 2 and plate antenna 15. If the detected current is represented by I, then the current is found as follows:

$$I = (\text{electrification frequency}) \times (\text{capacity between roller and antenna}) \times (\text{applied electrification voltage})$$

As mentioned above, there are full-speed and half-speed modes for the process speed of the image forming apparatus, and the electrification frequency is f=3000 Hz in the full-speed mode and f=1500 Hz in the half-speed mode. Since these frequencies differ greatly from each other, the current I detected as the value of the electrostatic capacity is influenced greatly by the change in electrification frequency between the two modes.

FIG. 3 illustrates the detected voltage value corresponding to the electrostatic capacity between the plate antenna 15 and the developing roller 2, which differs in the full- and half-speed modes owing to a difference in the electrification frequency, which is an electrification condition, between these two modes. This graph indicates that even though the amounts of toner are exactly the same, the detected voltage value in a case where the image forming operation is carried out in the full-speed mode differs from that in a case where the image forming operation is carried out in the half-speed mode.

Figure 2:
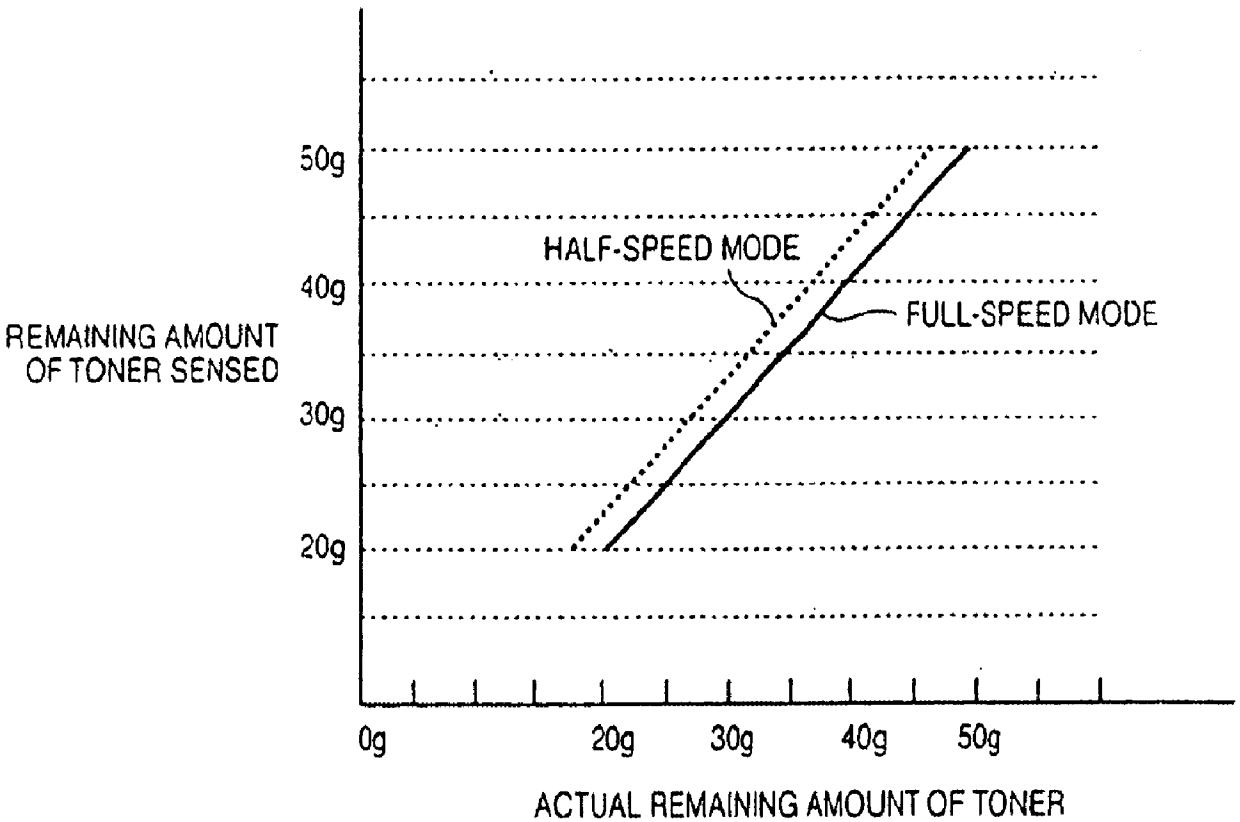
FIG. 2 is a graph illustrating an example of the relationship between the remaining amount of toner, which is sensed by a printer premised on the first embodiment of the present invention, and the actual remaining amount of toner.

Accordingly, if the amount of toner is obtained based upon the detected voltage value from the plate antenna 15 when the process speed is that of the half-speed mode by a method in which the full-speed mode serving as the usual process speed is adopted as a reference without taking into account the difference in electrification conditions that conform to the process speed, then an error will develop between the indicated remaining amount of toner and the actual remaining amount of toner when the half-speed mode is in effect, as illustrated in FIG. 2.

Accordingly, in this embodiment, a conversion to the remaining amount of toner is made upon approximating the difference in the detected voltage value as a constant δ and adding δ the derived detected voltage value in the half-speed mode.

The flow of processing for sensing the remaining amount of toner in the printer according to the first embodiment will be described with reference to FIGS. 6 and 7.

Figure 6:
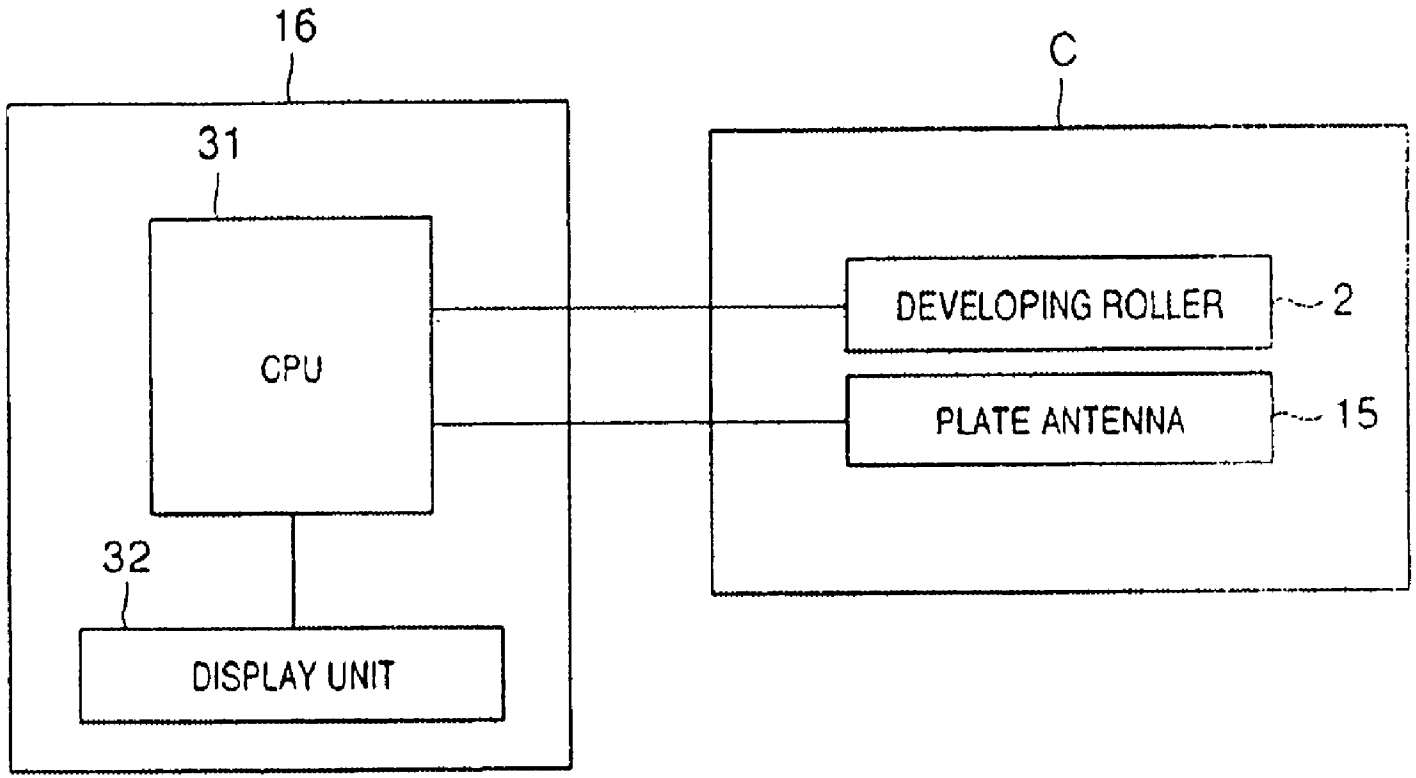
FIG. 6 is a block diagram illustrating the arrangement of the printer per se and the process cartridge in a case where processing for sensing the remaining amount of toner is considered.

FIG. 6 is a block diagram illustrating the arrangement of a printer main unit 16 and process cartridge C in a case where processing for sensing the remaining amount of toner is considered.

The printer main unit 16 is provided with a CPU 31 which, by executing a program stored in a ROM (not shown), determines whether the operating mode is the full-speed mode or half-speed mode and sets electrification conditions in conformity with the mode. The CPU 31 then applies voltage to the developing roller 2 and converts a detected voltage value, which has been obtained by the plate antenna 15, to the remaining amount of toner. If the mode is the half-speed mode at this time, a conversion to the remaining amount of toner is made using a conversion table for this purpose, which is shown in FIG. 3, upon adding δ to the detected voltage value obtained. Finally, the remaining amount of toner is displayed on a display unit 32. Here, the remaining amount of toner is displayed. However, the present invention is not limited to this arrangement. For example, an indication to the effect that it is time to replace the process cartridge may be displayed on the display unit 32.

It is assumed that the value of δ and the table for converting values to remaining amounts of toner have already been stored in a ROM (not shown) in CPU 31.

The conversion table is obtained by storing values of remaining amounts of toner in grams or percent corresponding to values obtained by adding the value of δ to detected voltage values obtained by the plate antenna 15. The CPU 31 reads a remaining amount of toner, which corresponds to a value obtained by adding the value of δ to a detected voltage value obtained by the plate antenna 15, out of the table and displays this value on the display unit 32. It is assumed that the table is applied to a process cartridge that can initially accommodate 500 g of toner. The conversion table is designed to be used when the remaining amount of toner is 50 g or less.

It should be noted that the values in the conversion table of FIG. 17 indicate only one example and the invention is not limited to these values. The values can be changed as appropriate in accordance with the toner capacity of the cartridge.

Figure 7:
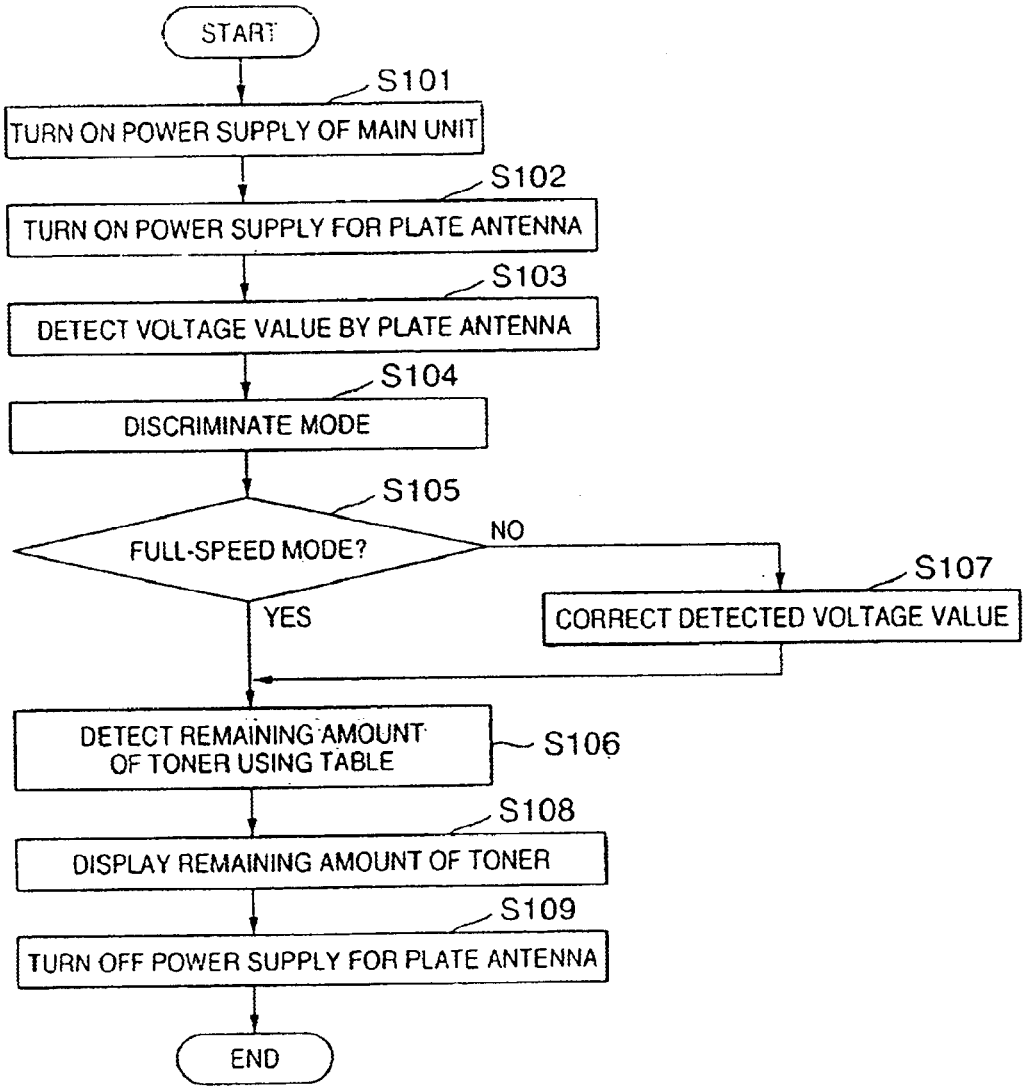
FIG. 7 is a flowchart illustrating the flow of processing for sensing the remaining amount of toner in the printer according to the first embodiment.

FIG. 7 is a flowchart illustrating the flow of processing for sensing the remaining amount of toner in the printer according to the first embodiment. The processing in the flowchart set forth below is implemented by having the CPU 31 execute a program that has been stored in a ROM (not shown).

First, the power supply of the printer is turned on (S101) and then a power supply for the plate antenna is turned on (S102). The power supply for the plate antenna may employ the power supply 41, which supplies bias voltage to the developing roller, or a power supply provided separately of the power supply 41 may be used. A case where the plate-antenna power supply is provided separately of the power supply 41 will be described as an example.

Next, the voltage value is detected by the plate antenna (S103) and then the CPU 31 determines whether the operating mode is the full-speed mode or half-speed mode (S104).

In the case of the full-speed mode, control proceeds from step S105 to step S106, where the CPU 31 converts the detected voltage value to the remaining amount of toner using the remaining-amount conversion table of FIG. 17 that has been stored in a ROM (not shown) provided in CPU 31.

In the case of the half-speed mode, control proceeds from step S105 to step S107, where the constant δ is added to the detected voltage value. Control then proceeds to step S106, where the remaining amount of toner is found from the remaining-amount conversion table.

Next, control proceeds to step S108, where the remaining amount of toner derived at step S106 is displayed on the display unit 32.

Finally, the power supply for the plate antenna is turned off at step S109. This ends processing for sensing the remaining amount of toner.

Figure 1:
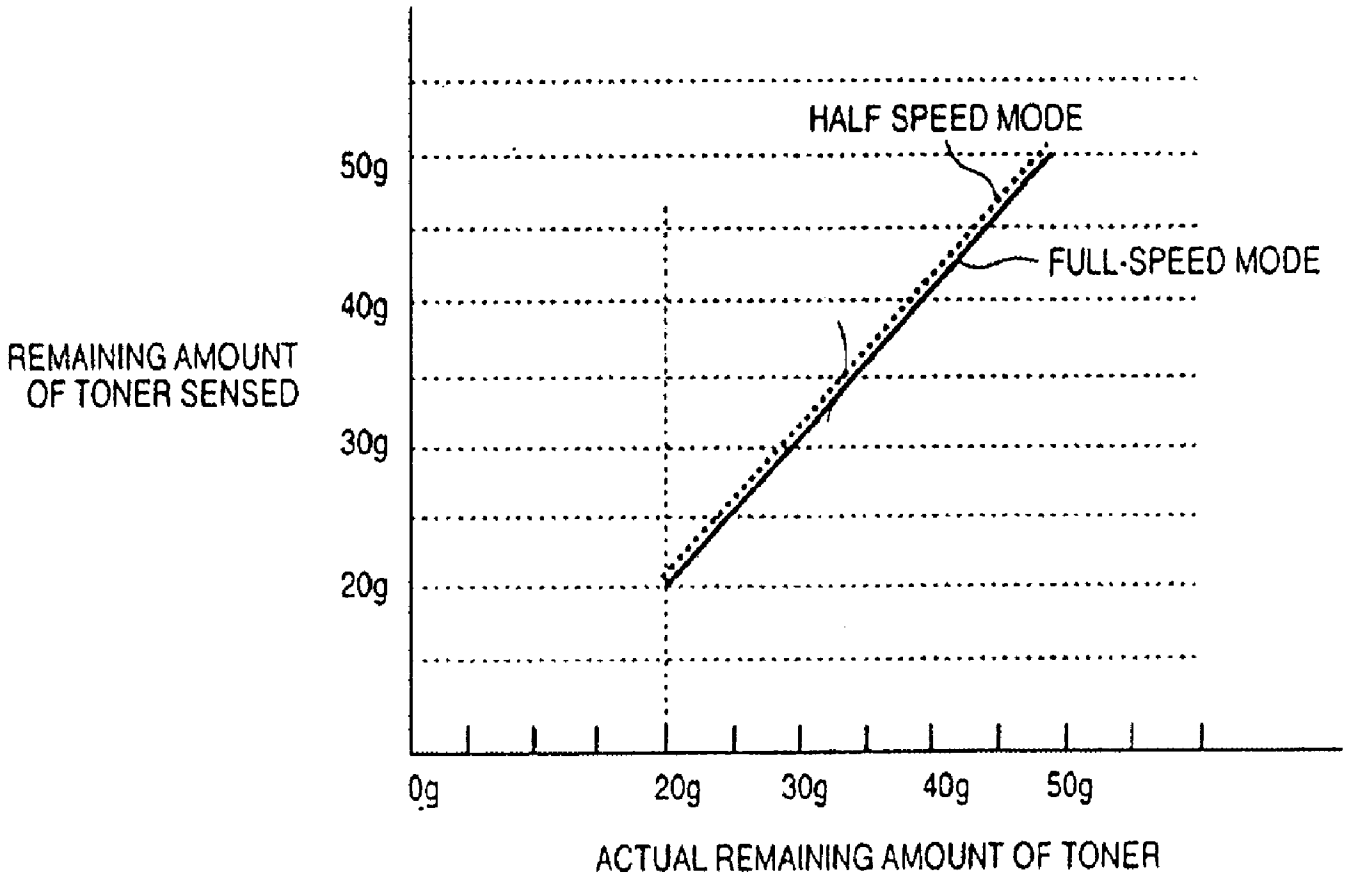
FIG. 1 is a graph illustrating an example of the relationship between the remaining amount of toner, which is sensed by a printer in a first embodiment of the present invention, and the actual remaining amount of toner.

By making a correction in accordance with electrification conditions in an image forming apparatus having a plurality of process speeds in which full- and half-speed modes can be selected, as in the above embodiment, the remaining amount of toner within the developing device can be detected and displayed accurately, as shown in FIG. 1, even with a printer in which full-speed and half-speed modes can be selected. As a result, the appropriate timing for replacement of a process cartridge can be indicated to the user. This makes it possible to prevent problems such as a printout that is too faint owing to lack of toner or a request to replace a process cartridge that still contains sufficient toner.

Second Embodiment

A printer according to a second embodiment of the present invention will now be described.

The printer according to this embodiment differs from that of the first embodiment in that three speed modes can be set. Since this embodiment is similar in other aspects of structure and operation, identical components are designated by like reference characters and need not be described again.

In this embodiment, a full-speed mode (300 mm/s), a half-speed mode (150 mm/s), and a one-third-speed mode (100 mm/s) may be set as the three speed modes. For example, it is possible to set the full-speed mode if the printing medium is plain paper, the half-speed mode in case of thick paper, and the one-third-speed mode in case of OHT. The mode may be changed in dependence upon the size of the printing medium in addition to the type thereof.

Figure 10:
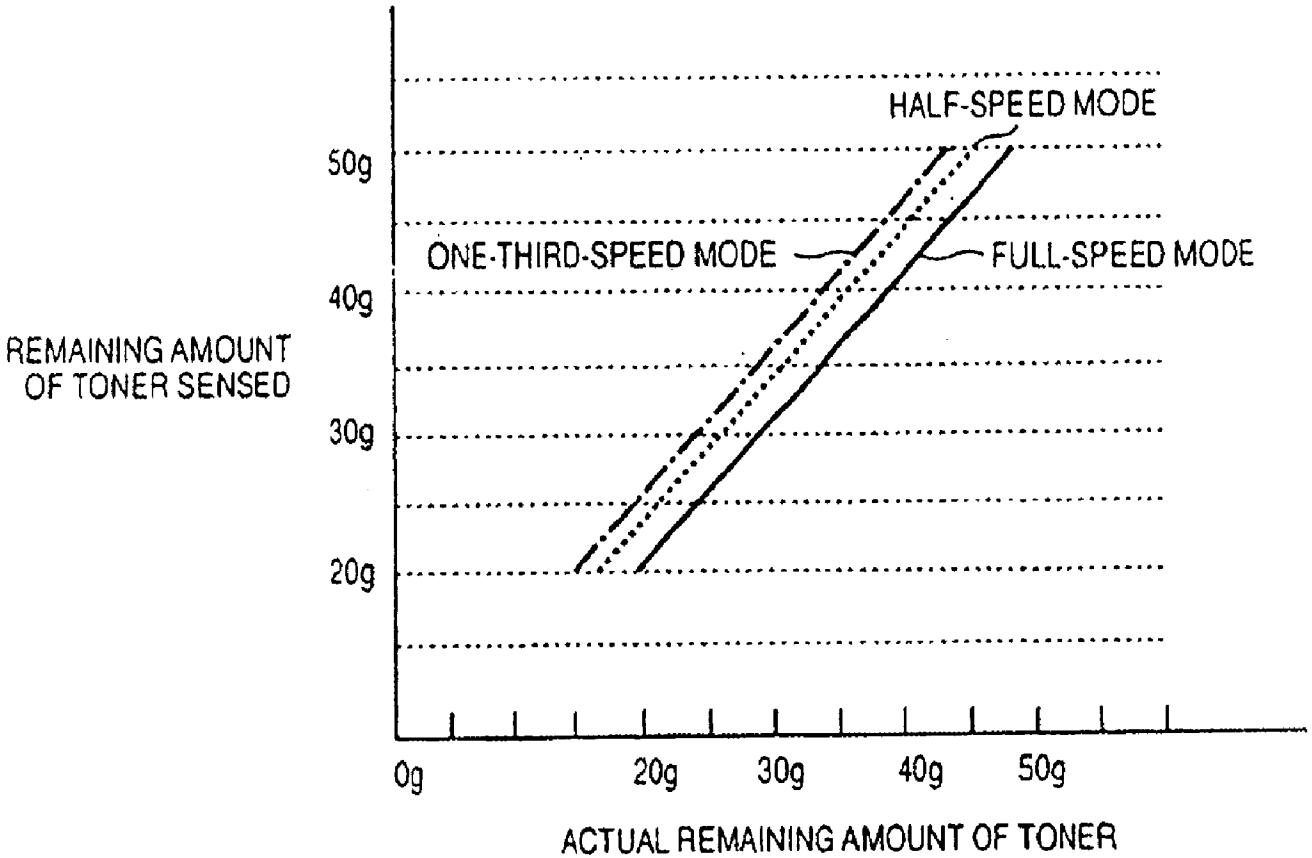
FIG. 10 is a graph illustrating an example of the relationship between the remaining amount of toner, which is sensed by a printer premised on the second embodiment of the present invention, and the actual remaining amount of toner.
Figure 11:
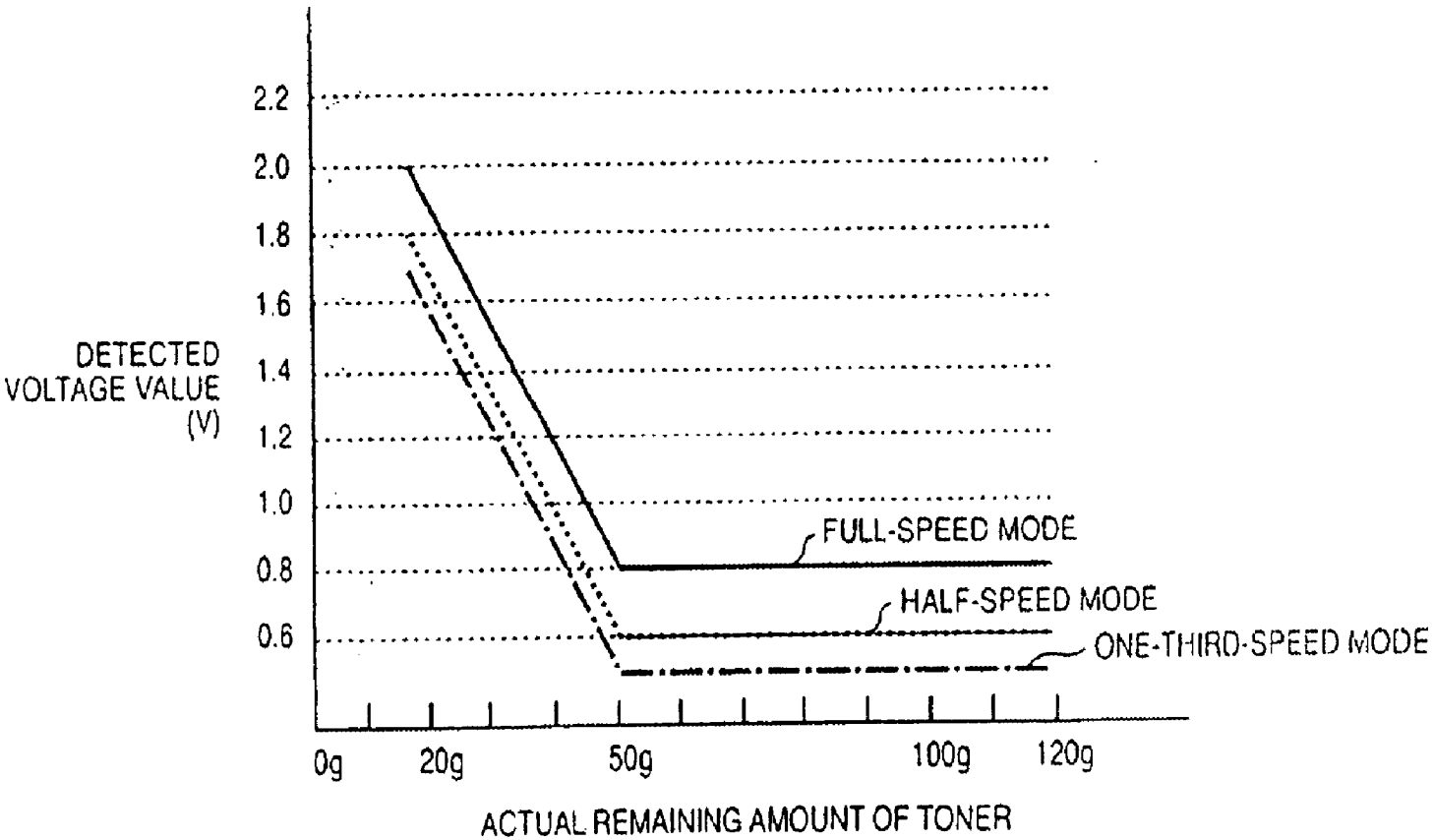
FIG. 11 is a graph illustrating an example of the relationship between a voltage value, which is sensed by a printer in the second embodiment, and the actual remaining amount of toner.

In this case, a transition similar to that of FIG. 3 is made in the full- and half-speed modes. In the one-third-speed mode, the electrification frequency and the electrification current value are 1000 Hz and 1000 $\mu$A, respectively, and therefore the detected voltage value is less (see FIG. 11). Accordingly, in a case where no correction whatsoever is applied to the detected voltage value, the result is as shown in FIG. 10. Thus, the actual remaining amount of toner and the remaining amount of toner indicated differ.

In this embodiment, therefore, a correction value A for the one-third-speed mode is obtained separately from the correction value δ for the half-speed mode, this correction value Δ is added to the detected voltage value, and then a conversion is made to the remaining amount of toner.

Figure 8:
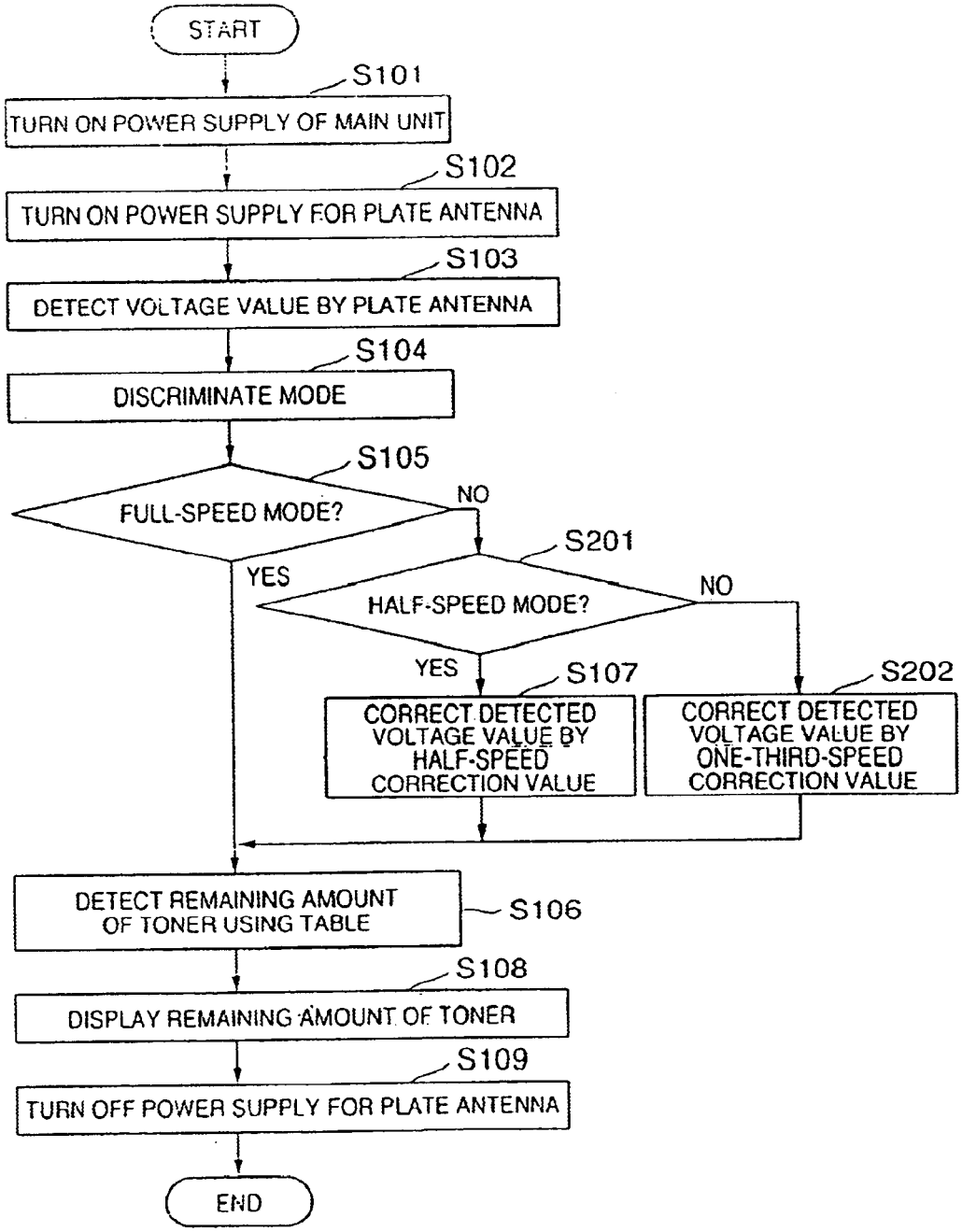
FIG. 8 is a flowchart illustrating the flow of processing for sensing the remaining amount of toner in a printer according to a second embodiment of the present invention.

FIG. 8 is a flowchart illustrating the flow of processing for sensing the remaining amount of toner in a printer according to the second embodiment of the present invention.

The processing of steps S101 to S109 are identical with that of FIG. 7 and need not be described again.

In this embodiment, control proceeds to step S201, where it is determined whether the operating mode is the half-speed mode, if it is determined at step S105 that the mode is not the full-speed mode. If the mode is the half-speed mode, control proceeds to step S107; otherwise, it is determined that the mode is the one-third-speed mode and the processing of step S202 is executed. Specifically, the correction value Δ for the one-third-speed mode is added on.

Figure 9:
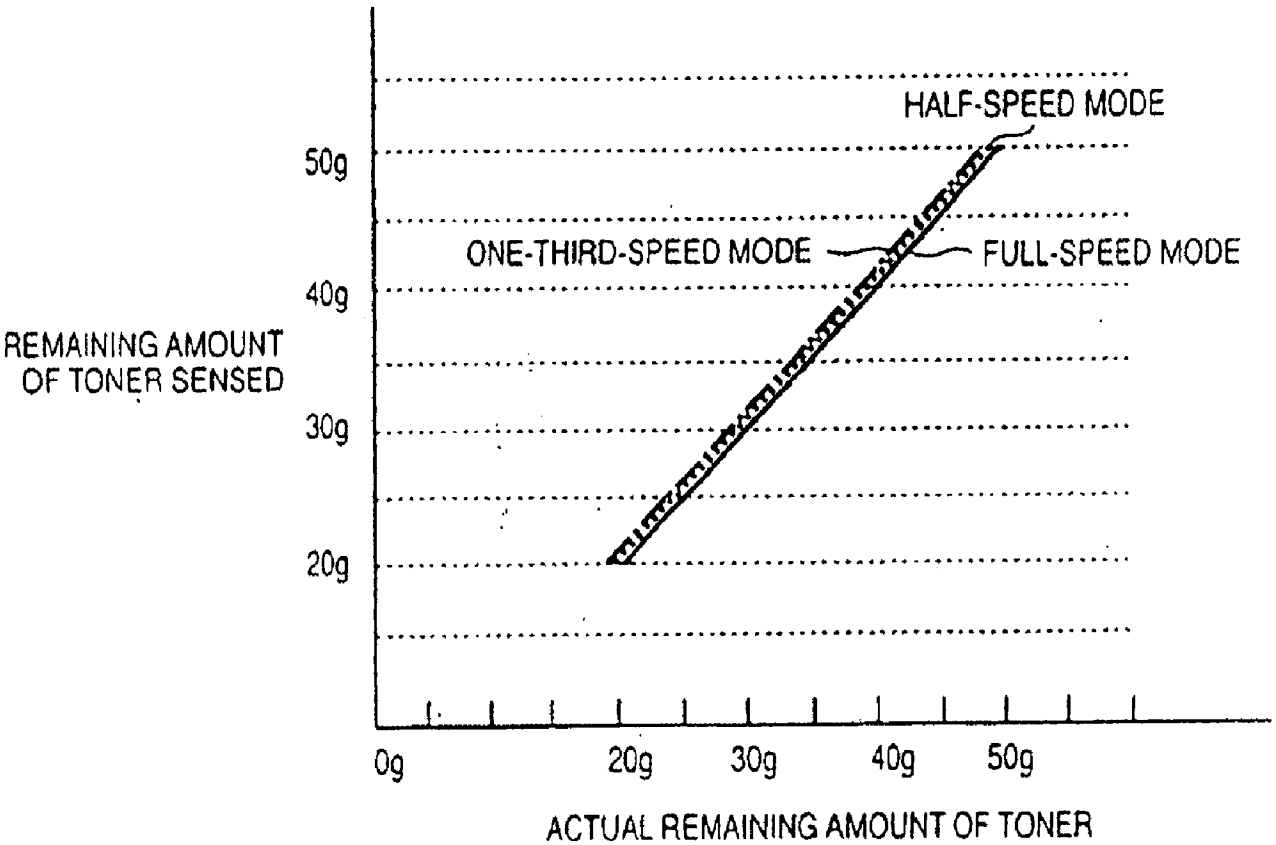
FIG. 9 is a graph illustrating an example of the relationship between the remaining amount of toner, which is sensed by the printer in the second embodiment of the present invention, and the actual remaining amount of toner.

In this embodiment also, the remaining amount of toner can be detected accurately, as shown in FIG. 9, by performing a correction that conforms to the electrification conditions in a manner similar to that of the first embodiment.

Third Embodiment

A printer according to a third embodiment of the present invention will now be described.

The printer according to this embodiment differs from that of the first embodiment in that the cartridge is provided with a memory. Since this embodiment is similar in other aspects of structure and operation, identical components are designated by like reference characters and need not be described again.

Figure 13:
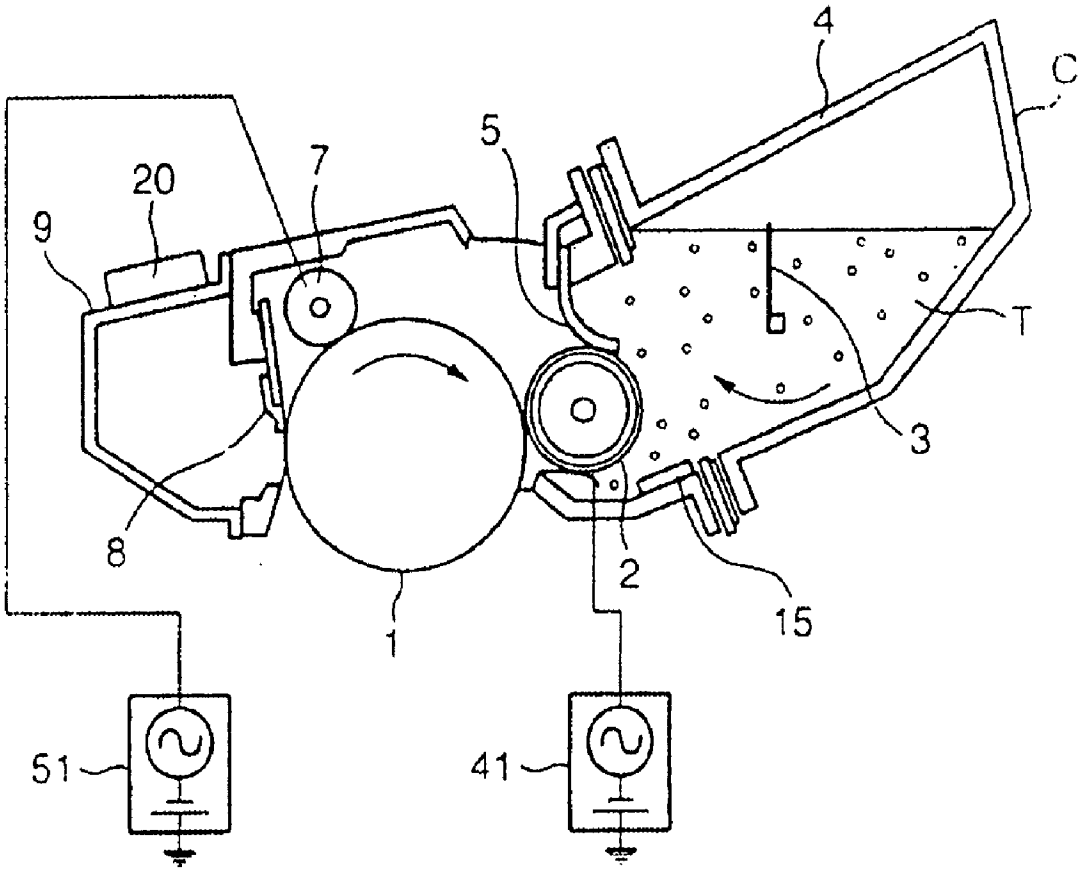
FIG. 13 is a diagram schematically illustrating a process cartridge removably loaded in a printer according to a third embodiment of the present invention.

As shown in FIG. 13, a memory 20 is a non-volatile memory (NVRAM) provided on the outer wall of the process cartridge C. Communication of data takes between the memory 20 and a data transceiver (not shown) provided on the main unit of the printer.

The value of δ for correcting the detected voltage in the half-speed mode is stored in the memory 20. Also stored in the memory 20 is a detected voltage value (denoted by PAF) of the remaining amount of toner prevailing when the cartridge is full of toner (see FIG. 15).

When the cartridge is full of toner, this means that the plate antenna 15 is completely covered with the toner. Usually the plate antenna 15 is disposed opposite the developing roller 2 in close proximity thereto, as shown in FIG. 13. The plate antenna 15 is provided in order to detect the remaining amount of toner accurately and finely in a state in which there is little toner left.

In general, the detected voltage value differs slightly from cartridge to cartridge even for the same remaining amount of toner and the same mode. This is because the electrostatic capacity possessed by a cartridge per se differs from that of other cartridges. For this reason, a cartridge-specific PAF is stored in the memory 20 in order to correct the detected voltage value in accordance with an individual difference from one cartridge to the next, and the remaining amount of toner is calculated by a calculation formula (described later) that uses the PAF. This difference in detected value from cartridge to cartridge can be regarded as being constant irrespective of the remaining amount of toner (see FIG. 16). If the mode differs, the detected voltage value also differs, as mentioned above.

Figure 16:
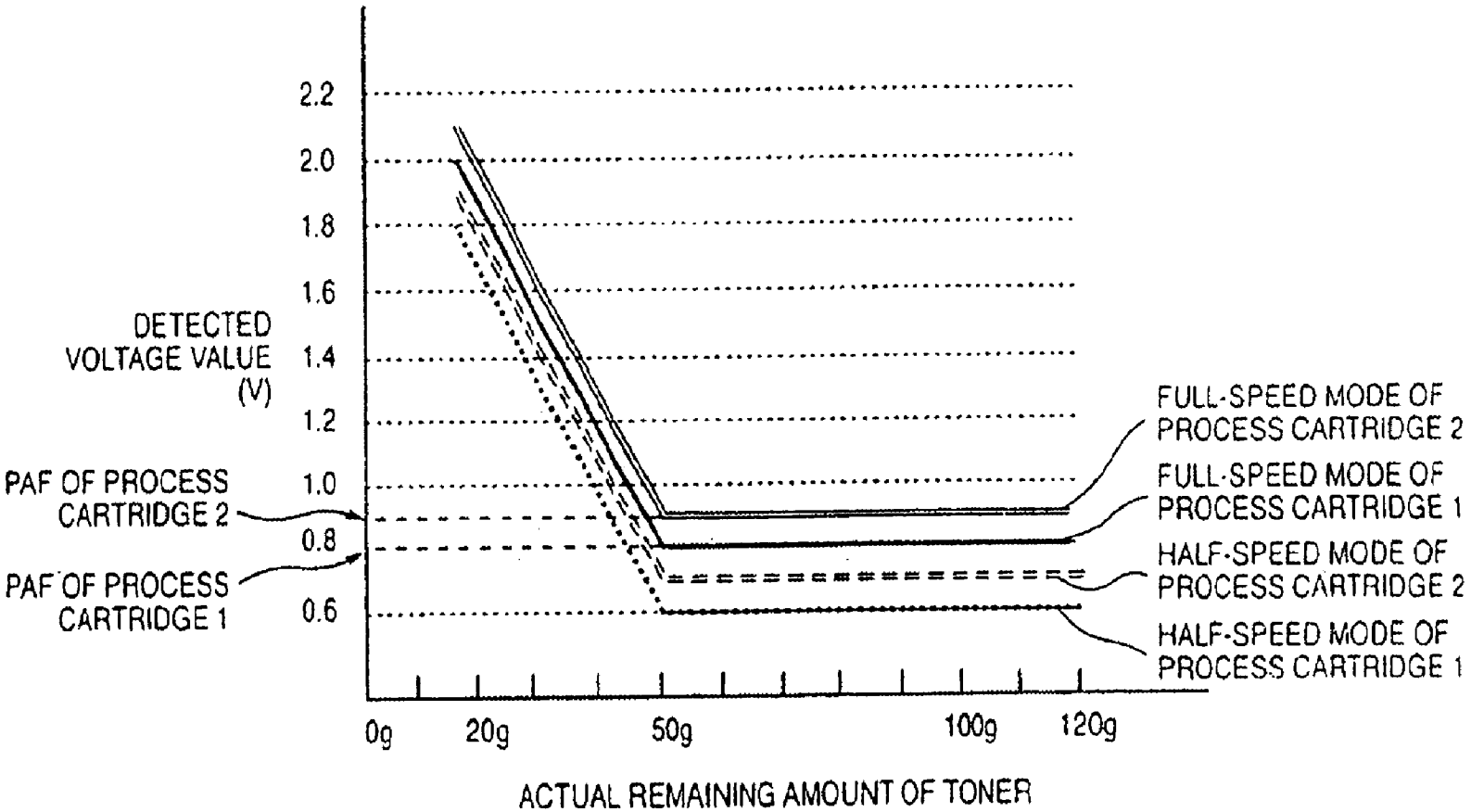
FIG. 16 is a graph illustrating an example of the relationship between a voltage value, which is sensed by the printer in the third embodiment, and the actual remaining amount of toner.

FIG. 16 is a graph illustrating an example of detected voltage values in the full-speed mode and half-speed mode of a process cartridge 1 and a process cartridge 2.

The positions of the plate antenna and developing sleeve, etc., differ somewhat from one process cartridge to another. Even if the remaining amount of toner is the same and the mode is the same, therefore, the detected voltage value will differ slightly from cartridge to cartridge. For example, FIG. 16 indicates that there is a difference of 0.1 V in the detected value between cartridges 1 and 2.

Accordingly, if the PAF of each cartridge is known, then the amount of toner can be found accurately based upon this value.

More specifically, if it is assumed that the relationship between the detected voltage value and the amount of toner follows the straight lines shown in FIG. 16, then a toner amount Y that is 50 g or less will be indicated by the two equations below. Specifically, in the full-speed mode, we have the following:

$$Y(g)=50-25\times[(\text{detected voltage value at full speed})-(PAF \text{ in full-speed mode})]$$

and in the half-speed mode, we have the following:

$$Y(g)=50-25\times[(\text{detected-voltage conversion value at half speed})-(PAF \text{ in full-speed mode})]$$

It should be noted that (detected-voltage conversion value at half speed) is the result of converting a detected voltage value prevailing at half speed to a voltage value prevailing at full speed.

In FIG. 16, the PAF in the full-speed mode of the process cartridge 1 is 0.8 V and the PAF in the full-speed mode of the process cartridge 2 is 0.9 V. Furthermore, in the full-speed mode, the detected voltage value is always 0.2 V higher in comparison with the detected voltage value in the half-speed mode. That is, δ=0.2 V holds. Since this value of d has been stored in the memory 20 beforehand, this value of δ is read out by the data transceiver on the side of the main unit and is used in calculating the remaining amount of toner when the half-speed mode is in effect. Accordingly, for the process cartridge 1, it will suffice to find the remaining amount of toner based upon the following at full speed:

$$Y(g)=50-25\times[(\text{detected voltage value})-0.8]$$

and based upon the following at half speed:

$$Y(g)=50-25\times[(\text{detected voltage at half speed}+0.2)-0.8]$$

The flow of processing for sensing the remaining amount of toner in a printer according to the third embodiment will now be described with reference to FIGS. 14 and 15.

Figure 15:
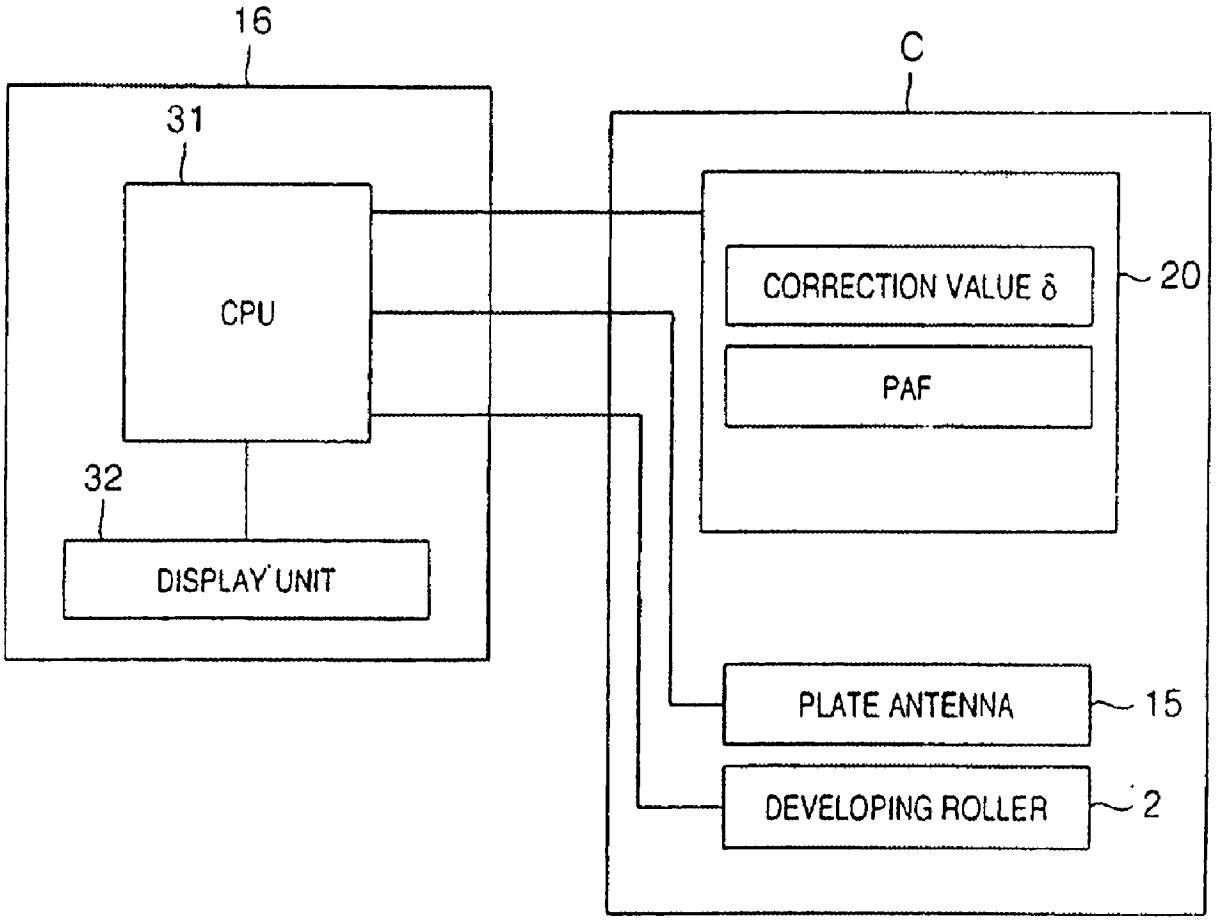
FIG. 15 is a block diagram illustrating the arrangement of the printer per se of the third embodiment and a process cartridge in a case where processing for sensing the remaining amount of toner is considered.

FIG. 15 is a block diagram illustrating the arrangement of the printer main unit 16 and process cartridge C in a case where processing for sensing the remaining amount of toner is considered.

The printer 16 is internally provided with the CPU 31, which serves as signal processing means, and with the display unit 32 that serves as display means. The cartridge C is internally provided with the memory 20 serving as storage means and with the plate antenna 15 serving as means for sensing the remaining amount of toner.

The memory 20 is provided with an area for storing plural items of information. The correction value δ for correcting the output value from the plate antenna 15 when the process speed is that of the half-speed mode, and the PAF value have been stored in this area.

The CPU 31 provided in the printer main unit 16, by executing a program stored in a ROM (not shown), determines whether the operating mode is the full-speed mode or half-speed mode, applies voltage to the developing roller 2 and converts a detected voltage value, which has been obtained by the plate antenna 15, to the remaining amount of toner by referring to the PAF and the value of δ that has been stored in memory 20. Finally, the remaining amount of toner is displayed on the display unit 32. Here the remaining amount of toner is displayed. However, the present invention is not limited to this arrangement. For example, a message to the effect that it is time to replace the process cartridge may be displayed on the display unit 32.

Figure 14:
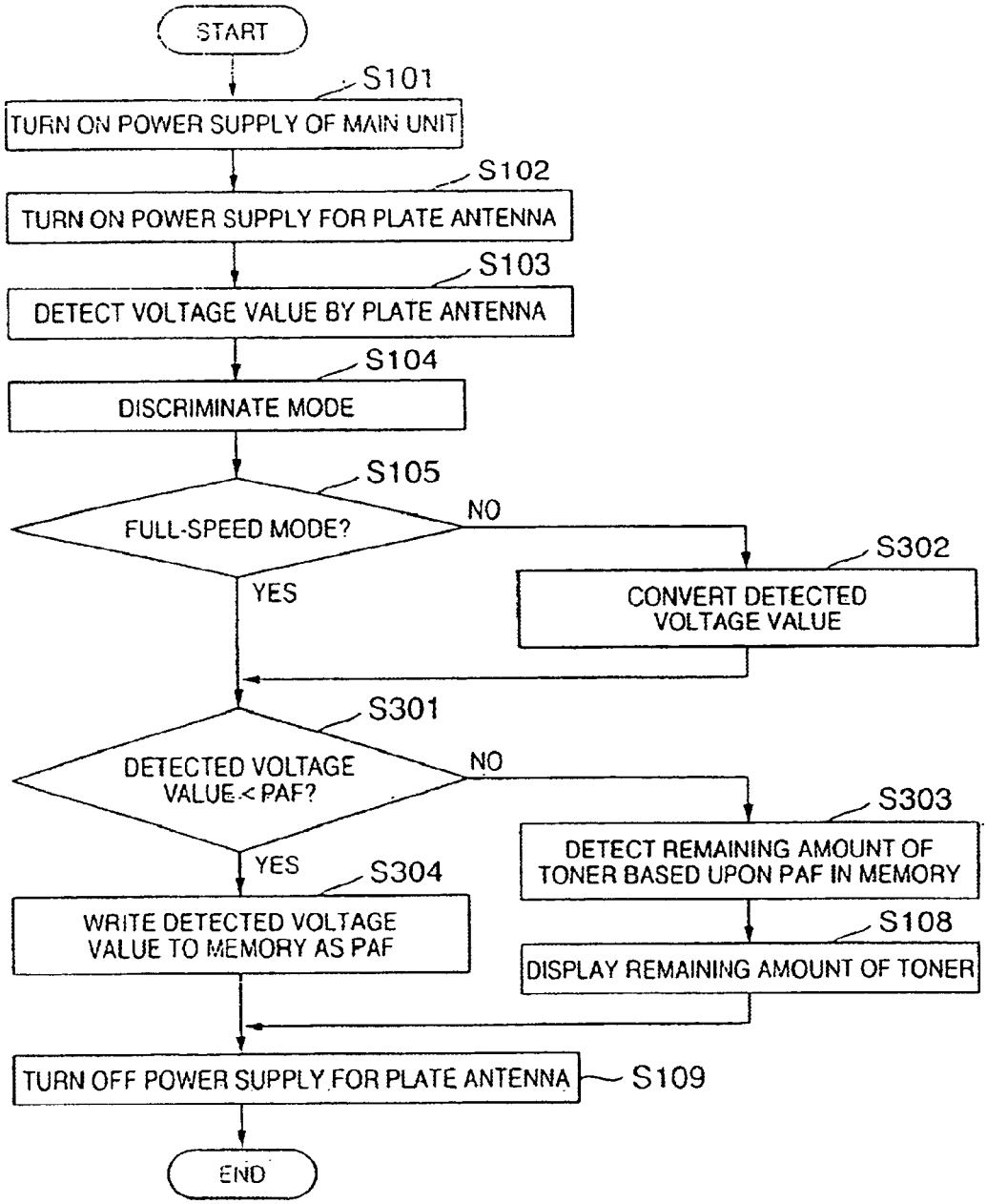
FIG. 14 is a flowchart illustrating the flow of processing for sensing the remaining amount of toner in the printer of the third embodiment.

FIG. 14 is a flowchart illustrating the flow of processing for sensing the remaining amount of toner in the printer according to the third embodiment.

The processing of steps S101 to S105, S108 and S109 is similar to that of FIG. 7 and need not be described again.

If it is determined at step S105 that the mode is the full-speed mode, control proceeds to step S301, where the detected voltage value is compared with the PAF.

On the other hand, if it is determined that the mode is not the full-speed mode, control proceeds to step S302, where the detected voltage value is corrected. This is followed by step S301.

If a comparison made at step S301 finds that the detected voltage value (the value after the correction in the case of the half-speed mode) is less than the PAF, then control proceeds to step S304, where the value is written to memory as the PAF. In other words, in actuality the PAF should be the minimum detected voltage value. However, if a voltage value smaller than the PAF is detected, then the PAF is rewritten to memory. This is control that is carried out to update and store the value of the PAF more accurately. At this time an indication to the effect that there is just enough toner remaining may be displayed.

Further, if the detected voltage value (the value obtained by conversion upon adding on δ in the case of the half-speed mode) is greater than the value of the PAF, then control proceeds to step S303, where the remaining amount of toner is detected based upon the PAF in memory. The remaining amount of toner is then displayed at step S108. If the detected voltage value is the same as the value of the PAF, then an indication to the effect that there is just enough toner remaining may be displayed.

Thus, by using the PAF stored in memory and the formula for calculating the remaining amount of toner in the full-speed mode, the amount of toner can be sensed accurately taking into consideration the error ascribable to the cartridge.

In this embodiment, only the PAF at the time of the full-speed mode is stored in memory, and the detected voltage is corrected in the half-speed mode. However, this does not impose a limitation upon the present invention, for both the PAF of the full-speed mode and the PAF of the half-speed mode may be stored in memory. In such case, a remaining amount of toner of 50 g or less will be represented by the following equation in accordance with the example of FIG. 16:

$$Y(g)=50-25\times[(\text{detected voltage value})-(PAF)]$$

More specifically, in the case of cartridge 1, the PAF in the full-speed mode is 0.8 V and the PAF in the half-speed mode is 0.6 V, and in the case of cartridge 2, the PAF in the full-speed mode is 0.9 V and the PAF in the half-speed mode is 0.7 V. The difference between the PAFs in the full- and half-speed modes is 0.2 V for both cartridge 1 and cartridge 2. Accordingly, it will suffice to substitute the detected voltage value in the following equation in the full-speed mode of process cartridge 1:

$$Y(g)=50-25\times[(\text{detected voltage value})-0.8)];$$

in the following equation in the half-speed mode of process cartridge 1:

$$Y(g)=50-25\times[(\text{detected voltage value})-0.6)];$$

in the following equation in the full-speed mode of process cartridge 2:

$$Y(g)=50-25\times[(\text{detected voltage value})-0.9)];$$

and in the following equation in the half-speed mode of process cartridge 1:

$$Y(g)=50-25\times[(\text{detected voltage value})-0.7)].$$

For example, in a case where the detected voltage value at full speed is 16 V for the cartridge 1, we have Y (g)=50−25×(16−0.8)=30 g. If the amount of toner when the cartridge is full is 300 g, "10%" is displayed as the remaining amount of toner.

In this embodiment, use is made of a calculation formula for calculating the remaining amount of toner. However, as in the first and second embodiments, it is permissible to use a conversion table of the kind shown in FIG. 17.

Further, this conversion table may be stored in a storage area of the memory 20 of the cartridge in advance, and the remaining amount of toner may be found in accordance with the detected voltage value based upon this conversion table.

Other Embodiments

In the foregoing embodiments, a correction is made in approximate fashion by adding δ to the detected voltage value in the half-speed mode. However, this does not impose a limitation upon the present invention. For example, it is permissible to use a table for converting a detected voltage value in the half-speed mode to a detected value in the full-speed mode, and in the half-speed mode it is permissible to use an independent table for converting a detected voltage value to a remaining amount of toner. Conversely, only a table for converting a detected voltage value to a remaining amount of toner in the half-speed mode may be prepared and, in case of the full-speed mode, a detected voltage value may be diminished by a predetermined correction value and the result may then be converted to the remaining amount of toner.

Further, in the foregoing embodiments, a plate antenna is used as a member for sensing the amount of developer. However, it is also possible to use a planar antenna. A planar antenna is a metal plate member for measuring the remaining amount of toner by a change in the electrostatic capacity between a pair of electrodes arranged in interdigital fashion. An example of this antenna is illustrated in FIG. 12.

Figure 12:
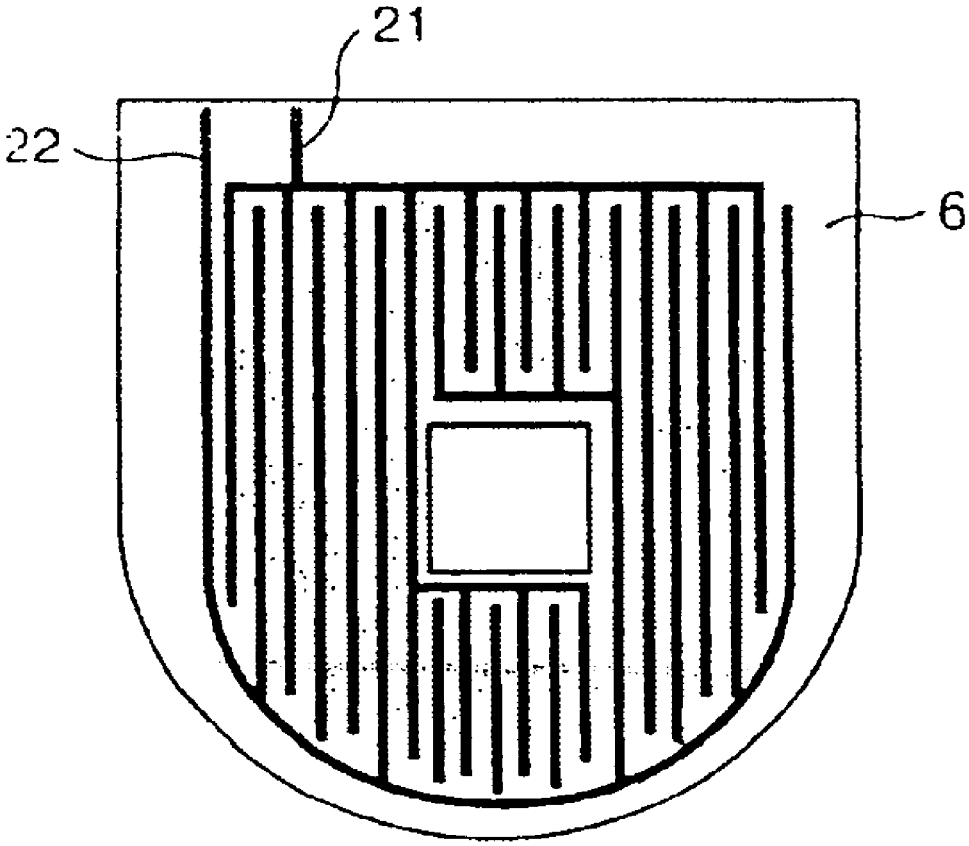
FIG. 12 is a diagram illustrating the structure of a planar antenna.

A planar antenna 6 shown in FIG. 12 is obtained by forming two electrodes, namely conductive patterns 21, 22, on a generally employed printed circuit board. After the conductive patterns are formed, an insulating protective film (not shown) is formed on the surface thereof in order to protect the patterns. A gap (G) between the two conductive patterns 21, 22 is narrowed down to 300 μm. The planar antenna 6 is mounted on the inner surface of the toner container 4. A decrease in the amount of toner T within the toner container 4 is accompanied by a decrease in the area of contact between the toner T and the planar antenna 6, and the electrostatic capacity between the electrodes 21 and 22 of the planar antenna 6 also decreases correspondingly. As a result, the amount of toner in the toner container 4 can be ascertained at any time by observing this electrostatic capacity.

In the above embodiments, a laser printer is described as an example of an image forming apparatus according to the present invention. However, the present invention is not limited to such a printer. The present invention is applicable to the fill spectrum of image forming devices that form images using a developer. Examples are printers and copiers that use LEDs instead of a laser-beam emission device.

In the above embodiments, a difference in electrification conditions is discriminated by discriminating the speed mode. However, this does not impose a limitation upon the invention. The electrification conditions may be discriminated by directly sensing the electrification bias applied to the electrification roller. Alternatively, the electrification conditions may be discriminated by sensing a drive signal applied to the driving motor of the photosensitive drum.

In the third embodiment, an NVRAM is used as the memory provided in the process cartridge. However, this does not impose a limitation upon the invention. Any storage means will suffice, such as a non-volatile memory, a contactless non-volatile memory capable of communicating wirelessly (e.g., via radio waves, light or infrared) with a data transceiver on the side of the main unit, or a volatile memory having a power source.

The present invention can be applied to a system constituted by a plurality of devices (e.g., a host computer, interface, reader, printer, etc.) or to an apparatus comprising a single device (e.g., a copier or facsimile machine, etc.).

Furthermore, it goes without saying that the object of the invention is attained also by supplying a storage medium (or recording medium) storing the program codes of the software for performing the functions of the foregoing embodiments to a system or an apparatus, reading the program codes, which have been stored on the storage medium with a computer (e.g., a CPU or MPU) of the system or apparatus, and then executing the program codes. In this case, the program codes read from the storage medium implement the novel functions of the embodiments, and the storage medium storing the program codes constitutes the invention. Furthermore, besides the case where the aforesaid functions according to the embodiments are implemented by executing the program codes read by a computer, it goes without saying that the present invention covers a case where an operating system or the like running on the computer performs a part of or the entire process in accordance with the designation of program codes and implements the functions according to the embodiment.

It goes without saying that the present invention further covers a case where, after the program codes read from the storage medium are written in a function expansion board inserted into the computer or in a memory provided in a function expansion unit connected to the computer, a CPU or the like contained in the function expansion board or function expansion unit performs a part of or the entire process in accordance with the designation of program codes and implements the functions of the above embodiments.

In a case where the present invention is applied to the above-mentioned storage medium, a program code corresponding to the flowcharts described earlier (FIG. 7 and/or FIG. 8 and/or FIG. 14) would be stored on the storage medium.

Thus, in accordance with the present invention, it is possible to provide an image forming apparatus, a process cartridge, a method of sensing the remaining amount of developer, a related program and a storage medium through which the amount of developer can be sensed accurately even if the electrification conditions of an image carrier change.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

an image carrier configured and positioned to carry an electrostatic latent image;

a developer accommodating container configured to accommodate a developer for developing the electrostatic latent image on said image carrier;

a developer carrier configured and positioned to carry the developer;

an electrifying member configured and positioned to electrify the surface of said image carrier;

a sensing member configured and positioned to sense the electrostatic capacity between said developer carrier and the sensing member and to generate a sensed value that conforms to the electrostatic capacity; and a control unit configured and positioned to obtain the amount of developer in said developer accommodating container based upon the sensed value and electrification conditions for electrifying said image carrier.

2. The apparatus according to claim 1, wherein the electrification conditions are changed in accordance with the image forming speed of said image forming apparatus.

3. The apparatus according to claim 1, further comprising storage media configured to store a table for converting the sensed value, which conforms to the electrostatic capacity between said developer carrier and said sensing member, to the amount of developer in said developer accommodating container, wherein said control unit obtains the amount of developer in said developer accommodating container using the table.

4. The apparatus according to claim 1, further comprising storage media configured to store data for correcting the sensed value that conforms to the electrostatic capacity between said developer carrier and said sensing member, and a sensed value that conforms to the electrostatic capacity between said developer carrier and said sensing member in a state in which said developer accommodating container is full of developer, wherein said control unit obtains the amount of developer in said developer accommodating container using the data stored in said storage media, and the sensed value that conforms to the electrostatic capacity between said developer carrier and said sensing member in a state in which said developer accommodating container is full of developer.

5. The apparatus according to claim 4, wherein said image carrier, said developer accommodating container, said developer carrier, said sensing member and said storage media are integrated into a single unit, and said unit is removably loaded in said image forming apparatus.

6. A cartridge removably loadable in an image forming apparatus, said cartridge comprising:

an image carrier configured and positioned to carry an electrostatic latent image;

a developer accommodating container configured and positioned to accommodate a developer for developing the electrostatic latent image on said image carrier;

a developer carrier configured and positioned to carry the developer;

a sensing member configured and positioned to sense the electrostatic capacity between said developer carrier and said sensing member and to generate a sensed value that conforms to the electrostatic capacity;

an electrifying member configured and positioned to electrify the surface of said image carrier; and storage media configured and positioned to store information relating to said cartridge, wherein said storage media have a storage area for storing data for correcting the sensed value, which conforms to the electrostatic capacity between said developer carrier and said sensing member, based upon electrification conditions for electrifying said image carrier.

7. The cartridge according to claim 6, further comprising a storage area configured to store a sensed value that conforms to the electrostatic capacity between said developer carrier and said sensing member in a state in which said developer accommodating container is full of developer.

8. A memory device mounted on a cartridge usable with a main body of an image forming apparatus that includes an image carrier configured and positioned to carry an electrostatic latent image, a developer accommodating container configured and positioned to accommodate a developer for developing the electrostatic latent image on the image carrier, a developer carrier configured and positioned to carry the developer, a sensing member configured and positioned to sense the electrostatic capacity between the developer carrier and the sensing member and to generate a sensed value that conforms to the electrostatic capacity, and an electrifying member configured and positioned to electrify the surface of the image carrier, said memory device comprising a storage area configured to store data for correcting the sensed value, which conforms to the electrostatic capacity between the developer carrier and the sensing member, based upon electrification conditions for electrifying the image carrier.

9. The device according to claim 8, further comprising a storage area configured to store a sensed value that conforms to the electrostatic capacity between the developer carrier and the sensing member in a state in which the developer accommodating container is full of developer.

10. The device according to claim 8, wherein the cartridge includes the image carrier configured and positioned to carry the electrostatic latent image, the developer accommodating container configured and positioned to accommodate the developer for developing the electrostatic latent image on the image carrier; the developer carrier configured and positioned to carry the developer, the r sensing member configured and positioned to sense the electrostatic capacity between the developer carrier and the sensing member and to generate the sensed value that conforms to the electrostatic capacity, and the electrifying member configured and positioned to electrify the surface of the image carrier.

11. A method of controlling an image forming apparatus that includes an image carrier configured and positioned to carry an electrostatic latent image, a developer accommodating container configured and positioned to accommodate a developer for developing the electrostatic latent image on the image carrier; a developer carrier configured and positioned to carry the developer, a sensing member configured and positioned to sense the electrostatic capacity between the developer carrier and the sensing member and to generate a sensed value that conforms to the electrostatic capacity, an electrifying member configured and positioned to electrify the surface of the image carrier, and a control unit configured and positioned to obtain the amount of developer in the developer accommodating container based upon the sensed value that conforms to the electrostatic capacity between the developer carrier and the sensing member, said method comprising:

a generating step of generating the sensed value by the sensing member; and a step of obtaining the amount of developer in the developer accommodating container based upon the sensed value and the electrification conditions for electrifying the image carrier.

12. The method according to claim 11, further comprising a step of changing the electrification conditions in accordance with image forming speed of the image forming apparatus.

13. The method according to claim 11, wherein the apparatus further comprises storage media configured and positioned to store a table for converting the sensed value to the amount of developer and, said step of obtaining the amount of developer obtains the amount of developer from the sensed value by using the table.

14. The method according to claim 11, wherein the apparatus further comprises storage media configured and positioned to store data for correcting the sensed value generated in said generating step, and a sensed value that conforms to the electrostatic capacity between the developer carrier and the sensing member in a state in which the developer accommodating container is full of developer, and said step of obtaining the amount of developer obtains the amount of developer in the developer accommodating container using the data stored in the storage media, and the sensed value that conforms to the electrostatic capacity in a state in which the developer accommodating container is full of developer.

15. An image forming apparatus comprising:

an image carrier configured and positioned to carry an electrostatic latent image;

a developer accommodating container configured and positioned to accommodate a developer for developing the electrostatic latent image on said image carrier;

a developer carrier configured and positioned to carry the developer;

a developer-amount sensor configured and positioned to sense the remaining amount of developer within said developer accommodating container utilizing a change in electrostatic capacity within a part of said developer accommodating container; and a setting device configured to set electrification conditions of said image carrier, wherein said developer-amount sensor derives the amount of developer based upon the electrification conditions that have been set by said setting device.

16. The apparatus according to claim 15, wherein said setting device sets the electrification conditions in accordance with the image forming speed of said image forming apparatus, and wherein said developer-amount sensor derives the amount of developer based upon the image forming speed.

17. The apparatus according to claim 15, further comprising a storage device configured to store data representing the sensed value of the electrostatic capacity, or a sensed value substituted therefor, in a state in which a maximum amount of developer is accommodated in said developer accommodating container; and wherein said developer-amount sensor derives the amount of developer based upon the sensed value that has been stored in said storage device.

18. The apparatus according to claim 15, wherein said developer-amount sensor includes:

a plate antenna disposed at a position opposing said developer carrier; and discrimination means for discriminating the amount of the electrostatic capacity by sensing current induced in said plate antenna when voltage is applied to said developer carrier.

19. The apparatus according to claim 15, wherein said developer-amount sensor includes a planar antenna configured and positioned to discriminate the electrostatic capacity based upon a potential difference between two spaced-apart electrodes.

* * * * *

UNITED STATES PATENT AND TRADEMARK OFFICE

CERTIFICATE OF CORRECTION

PATENT NO. : 6,947,678 B2
APPLICATION NO. : 10/372789
DATED : September 20, 2005
INVENTOR(S) : Yasunao Ohtomo et al.

It is certified that error appears in the above-identified patent and that said Letters Patent is hereby corrected as shown below:

COLUMN 6
Line 29, “plate” should read --the plate--.
Line 31, “plate” should read --the plate--.
Line 33, “plate” should read --the plate--.
Line 37, “plate” should read --the plate--.

COLUMN 8
Line 5, “half-speed” should read --the half-speed--.

COLUMN 9
Line 28, “takes” should read --takes place--.

COLUMN 10
Line 58, “half-speed” should read --the half-speed--.
Line 62, “memory” should read --the memory--.
Line 63, “Here the remaining” should be deleted.
Line 64, “amount of toner is displayed.” should be deleted.

COLUMN 12
Line 63, “fill spectrum” should read --full spectrum--.

Signed and Sealed this

First Day of August, 2006

JON W. DUDAS
*Director of the United States Patent and Trademark Office*